US011688249B1

(12) United States Patent
Winning

(10) Patent No.: US 11,688,249 B1
(45) Date of Patent: Jun. 27, 2023

(54) MEDIA ITEM TRANSPORT

(71) Applicant: NCR Corporation, Atlanta, GA (US)

(72) Inventor: Scott Winning, Dundee (GB)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 17/845,450

(22) Filed: Jun. 21, 2022

(51) Int. Cl.
*G07F 19/00* (2006.01)
*G07D 11/40* (2019.01)
*G07D 11/16* (2019.01)

(52) U.S. Cl.
CPC ..... *G07F 19/202* (2013.01); *G07D 11/16* (2019.01); *G07D 11/40* (2019.01)

(58) Field of Classification Search
CPC ..... G07F 19/202; G07D 11/40; G07D 11/16
USPC ..... 235/379
See application file for complete search history.

(56) References Cited

U.S. PATENT DOCUMENTS 6,036,089 A * 3/2000 Oguchi ..... G07F 19/20 235/487
2002/0003163 A1* 1/2002 Peebles ..... G07D 11/14 235/379
2003/0173402 A1* 9/2003 Ogawa ..... G07D 11/14 235/381
2009/0166372 A1* 7/2009 Kong ..... G07D 11/14 221/92
2014/0001104 A1* 1/2014 Petermann ..... G07D 11/10 209/534
2014/0001105 A1* 1/2014 Petermann ..... B65H 31/3027 209/534
2017/0228957 A1* 8/2017 Yokote ..... G07D 11/225
2018/0300990 A1* 10/2018 Kim ..... G07D 11/20
2020/0372765 A1* 11/2020 Paik ..... G07D 11/16
2022/0028202 A1* 1/2022 Woo ..... G07D 11/235
2022/0081246 A1* 3/2022 Kondou ..... B65H 20/00
2022/0139144 A1* 5/2022 Kimura ..... G07D 11/14 271/3.14

* cited by examiner

*Primary Examiner* — Daniel A Hess
(74) *Attorney, Agent, or Firm* — Notaro, Michalos & Zaccaria P.C.; John S. Economou

(57) ABSTRACT

A method and apparatus for determining at least a portion of a media item pathway are disclosed. The apparatus includes a transfer module comprising shafts that are rotatable and spaced apart in a substantially parallel relationship. A removable module is located with respect to the transfer module to selectively locate spaced apart rows of protruding guide elements with respect to the arm elements. At least one arm element comprises an abutment member that moves with the arm element and abuts with an abutment region of at least one guide element when a respective shaft element is rotated. A portion of a media item pathway is at least partially determined via opposed guide surfaces of the guide elements and the arm elements.

20 Claims, 14 Drawing Sheets

MEDIA ITEM TRANSPORT

FIELD

The present invention relates to a method and apparatus for improving the efficiency of media item transfer through Self Service Terminals (SSTs). In particular, but not exclusively, the present invention relates to helping avoid problems caused due to misalignment between modules within different zones inside an Automated Teller Machine (ATM) when removable modules are slid in and out of an ATM frame during servicing/replenishment.

BACKGROUND

Different types of Self Service Terminal (SST) are known. An example of an SST is an Automated Teller Machine (ATM). Other types of SSTs include Point of Sale Terminals such as check out terminals often used in a retail environment. Conventionally, an ATM is used within the field of Banking to provide a range of services to a customer where a number of different types of media item may be deposited into or withdrawn from the machine. For example, a customer may wish to withdraw banknotes, that will be dispensed from a safe inside the ATM. Instead of bank notes a media item may be a check that is being deposited or other token or the like. The physical transfer of media items through an ATM to facilitate such functions is provided by the so-called media handling system. The media handling system is a physical system of belts and other mechanical devices that is used to physically transfer media items to and from various locations within the ATM depending on what is required.

The media handling system of an ATM and the ATM itself may conceptually be broken down into several key subsystems. A lower zone of an ATM for example contains the storage locations for media items and includes a safe housing formed from strong safe walls. Storage locations might include multiple storage boxes of banknotes and checks and these are held in the safe housing. The safe housing includes a safe door that allows an operator to access the safe for replenishment or removal purposes. The safe housing around the lower zone of an ATM includes one or more apertures through which media items can be deposited into or withdrawn from the lower zone. These apertures are often located at an upper surface of the safe housing and may be formed as slits. Each zone within an ATM has a respective media handling subsystem that moves items of media to and from specified locations.

An upper zone of an ATM provides many remaining functions of the ATM, such as currency recognition, the stacking of media items, and an entrance/exit orifice for the purpose of dispensing and/or receiving media from the customer. A transfer zone is an interface region between the upper and lower zones. The transfer zone conventionally includes a mechanism at each aperture that provides access through the safe housing. This is a fixed position mechanism that provides an interface for bi-directional or uni-directional media item transferal between the lower zone and the upper zone of the ATM. Both the upper and lower zones of the ATM include removable modules mounted on cradles and racks and these may be slid in and out of the ATM by human operators for maintenance or inspection or replenishment or note removal. The media item transfer mechanisms associated with the transfer zone remains fixed in position secured at least in part to the rigid safe housing or frame of the ATM.

Common items that the media handling system of an ATM transports include banknotes, checks and other thin and flexible paper-like items. These media items are generally rectangular in shape with two spaced apart long edges and two shorter edges. The media items each require physical support throughout their length during transport, or they are liable to deform with unintended consequences such as deviation from an intended pathway. Conventionally when media items with paper-like characteristics move through the transfer zone of an ATM as the media items pass into or out of the safe housing, a leading long edge of the material may on occasion be led down an alternate undesired pathway resulting in a blockage. This can occur when finger-like guides of a transfer mechanism do not accurately align with cooperating fingers in an upper or lower removable module associated with the upper or lower zones. This may lead to an event referred to as a jam. This can cause the ATM to become non-operational which can lead to customer dissatisfaction and excess cost for those responsible for maintaining ATMs in working order.

There is a particular potential for depth misalignment when an ATM operator installs a removable module such as a lower module containing currency cassettes into the lower zone of the ATM by sliding the lower module on a racking system in the ATM. A similar misalignment problem could occur when an upper module containing some other component parts of an ATM is slid out of and then back into the upper zone of the ATM. This could be caused by the removable module sliding fractionally too far back or not far enough back on its racking mount in its associated cradle. For example this may be due to manufacturing tolerances in racking and motion stopping parts. This can lead to alignment issues at the interface of the transfer zone and upper zone and/or the transfer zone and the lower zone. This interface is sometimes referred to as the combing interface.

The sensitivity of paper-like media to alignment issues when being transferred between different zones of the ATM is high due to the order of magnitude difference between the width of the media transfer pathway compared to the size of individual modules in the lower or upper zones of an ATM.

SUMMARY

It is an aim of the present invention to at least partly mitigate one or more of the above-mentioned problems.

It is an aim of certain embodiments of the present invention to provide apparatus and a method for determining at least a portion of a media item pathway in an SST.

It is an aim of certain embodiments of the present invention to provide apparatus for helping determine a portion of a total media item pathway in an SST, such as an ATM, whereby the pathway portion is determined to help avoid a risk of jamming as media items such as bank notes or checks or the like are transported between modules that include parts of a media handling system within the ATM.

It is an aim of certain embodiments of the present invention to provide a method for determining at least a portion of a total media item pathway whereby as removable modules used to determine other parts of a media item pathway are selectively racked in and out of an ATM then performance at a transfer zone between the moveable modules is controlled so that a risk of a media item jamming item is obviated wholly or in part.

It is an aim of certain embodiments of the present invention to provide an intermediate transfer module of a type that can be secured at an interface zone between a safe and upper module cradle in an ATM and that reduces or eliminates risk of jamming when an item of media is passed through the intermediate transfer module.

It is an aim of certain embodiments of the present invention to help align guide arms and co-operating guide projections of opposed modules in an SST whereby alignment occurs in a way which is independent of manufacturing tolerance and racking tolerance when parts of the ATM such as a lower module, including a lower media handling subsystem and currency cassette/s and intermediate transfer module of an ATM are located with respect to each other.

It is an aim of certain embodiments of the present invention to address the issue of media path deviation at the combing interface between the lower zone and transfer zone and between the upper zone and transfer zone in an ATM. The consequence of media path deviation is frequently a blockage, thus preventing further media from being transferred until the blockage is addressed.

It is an aim of certain embodiments of the present invention to provide a method for consistently aligning directing elements in a transfer zone with directing elements in the lower zone or aligning the directing elements of the transfer zone with directing elements in the upper zone by use of a reference point on the pathway directing elements themselves.

It is an aim of certain embodiments of the present invention to address the problem of media items occasionally deviating from an intended/desired pathway between the lower zone and transfer zone or the upper zone and the transfer zone of an SST, such as an ATM, due to misalignment between the modules of the lower zone and the transfer zone or the upper zone and the transfer zone.

According to a first aspect of the present invention there is provided apparatus for determining at least a portion of a media item pathway, comprising:

a transfer module comprising a first and further rotatable shaft element in a substantially parallel spaced apart relationship; and a removable module that is locatable with respect to the transfer module to selectively locate two spaced apart rows of protruding guide elements of the removable module with respect to arm elements carried in a spaced apart relationship on the first and further shaft element; wherein at least one arm element comprises an abutment member that moves with the arm element and abuts with an abutment region of at least one guide element when a respective shaft element is rotated to move the arm element from a retracted position to an operational position in which a media item pathway is at least partially determined via opposed guide surfaces of the guide elements and the arm elements.

Aptly, in the retracted position the transfer module and removable module are laterally locatable with respect to each other and in an operational position, when the transfer module and the removable module are in a fixed respective location with respect to each other, a tip region of a guide surface of each arm element is spaced at least a predetermined threshold distance from a guide surface provided by an adjacent at least one guide element of the removable module.

Aptly, the tip region of each arm element extends for a distance of at least 5 mm along an edge of a respective arm element away from a terminal end extremity of the arm element and a whole of the tip region is at least a predetermined threshold distance of 1.5 mm set back from a guide surface of an adjacent guide element when viewed in an end on view.

Aptly, a first plurality of arm elements carried by a respective first shaft element is independently locatable with respect to a further plurality of arm elements carried by the further shaft element by rotating a respective first and/or further rotatable shaft element independently.

Aptly, the apparatus further comprises a first and a further biasing element, each disposed at a biased end region of a respective shaft element and disposed to bias the respective shaft element in a favored rotational direction.

Aptly, each biasing element comprises a torsion spring fixed, at one spring end, to a region of the transfer module and at a remaining spring end to a respective shaft element, wherein each torsion spring urges and thereby biases a respective shaft element in a rotational direction that biases arm elements extending along that shaft element into the operational position.

Aptly, each abutment member comprises a rod element, having a cylindrical outer surface region, that extends away from and is connected to at least one arm element at an edge of an arm element that is disposed distal to a guide surface provided by a region of a remaining edge of the arm element and optionally said an edge comprises an edge that trails as the arm element moves, from a retracted to an operational position.

Aptly, at least one arm element of each plurality of arm elements comprises a respective abutment member that each stops rotational movement of arm elements carried by a respective shaft element at a respective desired rotational position that thereby sets the arm elements in respective operational positions.

Aptly, a respective desired rotational position of the first shaft element about a respective longitudinal axis of the first shaft element is independent of a respective desired rotational position of the further shaft element about a respective longitudinal axis of the further shaft element.

Aptly, the apparatus further comprises a first and a further pinion element, each comprising respective pinion teeth disposed to engage with rack teeth of a respective one of a first and further rack element and turn as the rack element moves, wherein the first pinion element moves with, and is disposed on a pinion end region of, the first shaft element and the further pinion element moves with, and is disposed on a pinion end region of, the further shaft element and pinion teeth of the first pinion element are not meshed with pinion teeth of the further pinion element.

Aptly, the transfer module comprises a pusher plate member; and the removable module comprises a drive element that is disposed to engage with a pusher plate push surface of the pusher plate member when the removable module is moved towards and proximate to the transfer module.

Aptly, the pusher plate member comprises an upper rack contact arm, that extends towards a body of a first rack element, and a lower rack contact arm, that extends towards a body of a further rack element.

Aptly, the body of the first rack element has respective rack teeth that extend downwards in use; and the body of the further rack element has respective rack teeth that extend upwards in use.

Aptly, the apparatus further comprises a pusher plate biasing element that biases the pusher plate member in a direction towards the drive element and optionally the pusher plate biasing element is an extension spring or a compression spring.

Aptly, each arm element comprises an elongate body that is integrally formed with a single respective shaft element or that is secured to a respective shaft element at a root region of the arm element.

Aptly, each elongate body comprises a first edge and a remaining edge; the first edge extends between a terminal end extremity of the arm element and a root region proximate to the respective shaft element; and the remaining edge is curved or is angled as the remaining edge extends from the terminal end extremity to the root region whereby the body has a thickness in cross section that is greater proximate to the root region than at the terminal end extremity.

Aptly, the transfer module comprises a rigid cuboid shaped housing having spaced apart side walls and spaced apart end walls and an open bottom and an open top; and a first item guide body and a further item guide body disposed in a spaced apart relationship and extending at least partially between the open bottom and open top.

Aptly, the transfer module comprises an intermediate module secured over a media access aperture in an upper region of a safe housing of an Automated Teller Machine (ATM); and the removable module comprises a lower module that is selectively slidable into the safe housing of the ATM by a security operator and wherein a slit in the removable module is located between the rows of protruding guide elements for enabling media items to pass into the safe housing of the ATM or the removable module comprises an upper module that is selectively slidable in an ATM.

According to a second aspect of the present invention there is provided a method for determining at least a portion of a media item pathway, comprising the steps of:

locating a transfer module comprising a first and further rotatable shaft element in a substantially spaced apart parallel relationship, with respect to a removable module thereby locating two spaced apart rows of protruding guide elements of the removable module with respect to arm elements carried in a spaced apart relationship on the first and further shaft element;

as the transfer module and the removable module are mutually located, rotating the first and further shaft elements thereby moving arm elements carried on the respective shaft elements from a retracted position to an operational position; and when an abutment member that moves with at least one arm element, abuts with an abutment region of at least one guide element, stopping further rotation of a shaft element carrying said arm element thereby setting the arm element in an operational position thereby at least partially determining a media item pathway via opposed guide surfaces of the guide elements and guide surfaces of the arm elements.

Aptly, the method further comprises, with the arm elements carried on both shaft elements in their retracted position, locating the removable module laterally with respect to the transfer module by urging and thereby sliding the removable module that comprises a lower module into a safe housing, of an ATM, that comprises a media item aperture.

Aptly, the method further comprises, as each arm element adopts a respective operational position, locating a tip region of a guide surface of each arm element at least a predetermined threshold distance from a guide surface provided by an adjacent at least one guide element of the removable module.

Aptly, the tip region of each arm element extends for a distance of at least 5 mm along an edge of a respective arm element away from a terminal end extremity of the arm element, and rotating each arm into an operation position comprises locating a whole of the tip region of each arm element at least a predetermined threshold distance of 1.5 mm set back from a guide surface of an adjacent guide element in a direction away from a slot between the two spaced apart rows.

Aptly, the method further comprises independently locating arm elements carried on the first shaft element with respect to arm elements carried on the further shaft element by independently rotating each shaft element.

Aptly, the method further comprises, as the removable module is moved towards and proximate to the transfer module, automatically rotating the first and further shaft element to move arm elements into respective operational positions.

Aptly, the method further comprises, as the removable module is moved from a proximate position away from the transfer module, automatically rotating the first and further shaft elements to move arm elements into respective retracted positions.

Aptly, the method further comprises, as the removable module is moved towards the transfer module, engaging a drive element of the removable module with a pusher plate member; and as the pusher plate member is urged by the drive element, pulling at least one rack element thereby rotating a pinion element mounted to a respective shaft element and having pinion teeth meshed with rack teeth of the rack element.

Aptly, via the pusher plate member, selectively pulling two rack elements each associated with a respective pinion element that is at, and moves with, an end region of a respective shaft element thereby independently rotating each shaft element into a desired rotational position as the removable module is moved with respect to the transfer module.

According to a third aspect of the present invention there is provided an Automated Teller Machine (ATM), comprising:

a safe housing that comprises a safe chamber for receiving at least one currency cassette and that comprises at least one media access aperture in an upper surface;

at least one transfer module provided as an intermediate module secured proximate to a respective media access aperture; and at least one removable module comprising a lower module, slidable into the safe housing for supporting at least one currency cassette, or an upper module, slidable with respect to the safe housing; wherein a media item pathway determined for media items passing through the aperture is determined by guide surfaces of guide elements of the removable module and guide surfaces of arm elements of the transfer module that co-locate with respect to each other responsive to a mutual position when the removable module is located with respect to the first transfer module.

Aptly, as the lower module is racked into the safe housing, a reference point associated with guide elements of the lower module, and not a fixed point associated with the transfer module, is used to determine the rotational orientation of an operational position of arm elements of the intermediate module, wherein guide surfaces of the arm elements are set back from guide surfaces of the guide elements in a direction away from a media item pathway by at least a predetermined distance that prevents a leading edge of a media item passing through the media access aperture from jamming.

Certain embodiments of the present invention provide an apparatus and method for determining at least a portion of a media item pathway in which opposed guide surfaces of elements used to help guide a media item along a pathway are accurately aligned with respect to each other to help wholly avoid or reduce the risk of jamming.

Certain embodiments of the present invention provide an Automated Teller Machine (ATM) that includes a safe and a removable lower and/or upper module that each include respective media handling transport modules with one or more intermediate transfer modules located therebetween around respective apertures in a safe housing of the ATM.

Certain embodiments of the present invention provide a reference point, for guide arms of an intermediate transfer module, that is associated with a mutual position of those guide arm elements and co-operating guide projections that move with a moveable module rather than any arbitrary fixed point in an ATM. This helps co-locate the guide projections and arm elements, which each include guide surfaces, to achieve better alignment and mitigate problems associated with transfer manufacturing tolerances.

Certain embodiments of the present invention provide a transfer module, which may be an intermediate module of an ATM and a further removable module which may be a lower module or upper module of an ATM, whereby component parts of the transfer module and a removable module cooperate with respect to a mutual position rather than a fixed point associated with the safe or outer frame of the ATM so that guide surfaces presented to media items being transferred are arranged in a mutual cooperating fashion to help determine a media item pathway into and out of the transfer module.

Certain embodiments of the present invention address the problem of media items deviating from a desired/intended path and thus jamming in an ATM. This is achieved by determining at least a portion of a media item pathway between a fixed transfer module and a moveable module in a way that sets guide surfaces in respective locations that does not risk an edge of a media item infiltrating between guide surfaces provided by adjacent guide arms/projections.

Certain embodiments of the present invention overcome a problem of media items occasionally deviating from the intended path between the lower zone and transfer zone or the upper zone and the transfer zone in an SST due to misalignment between the modules of the lower zone and the transfer zone or the upper zone and the transfer zone when an operator racks the modules in and out of the SST.

BRIEF DESCRIPTION OF THE DRAWINGS

Embodiments of the present invention will now be described hereinafter, by way of example only, with reference to the accompanying drawings in which.

DETAILED DESCRIPTION

Figure 1:
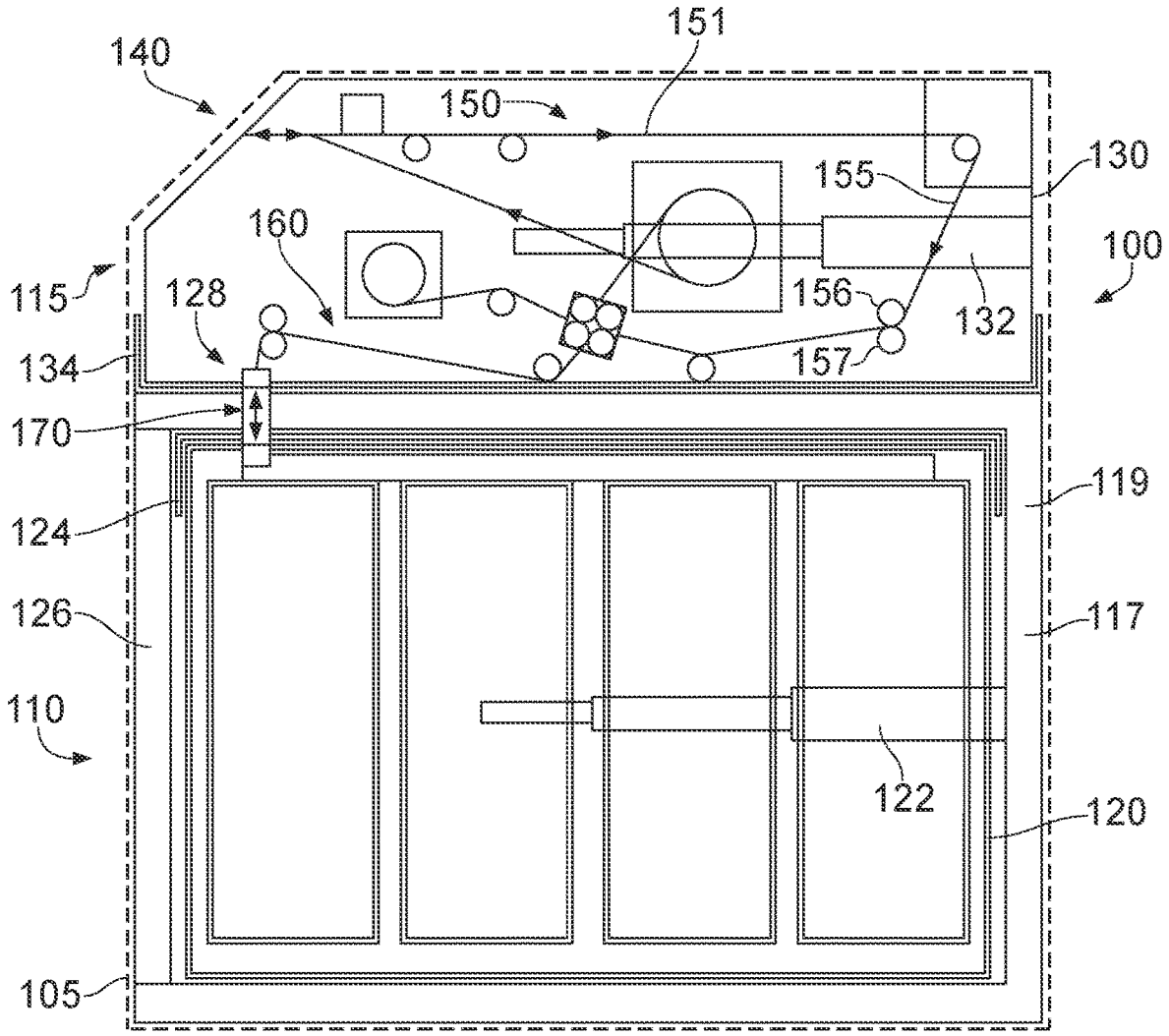
FIG. 1 illustrates a diagrammatic view of a Self Service Terminal (SST), shown as an Automated Teller Machine (ATM), and paths used to transfer media items to different areas of the SST.

In the drawings like reference numerals refer to like parts.

FIG. 1 helps illustrate a Self Service Terminal (SST) 100. The SST illustrated is an automated teller machine (ATM). The ATM 100 includes a frame 105 which defines an outer extremity of the ATM. The frame and parts within the ATM help define a lower region or zone 110 and an upper region or zone 115 of the ATM. The lower region 110 includes a safe 117, which is formed by rigid metal walls 119 these define a central chamber in the safe, and a lower removable module 120, which can be used to house separate currency cassettes or the like, which is selectively locatable within the chamber and thus the safe. The lower removable module 120 is arranged to slide on telescopic mounts 122. That is to say there is a mount part on opposed sides of the safe. Part of a mount 122 is secured near the inner surface of the walls of the safe to a lower cradle 124 whilst a further part of the mount is carried on the lower slidable module. By opening a safe door 126 at a front (shown in the left hand side of FIG. 1) side of the ATM an operator can selectively access the central chamber and selectively remove the lower module 120 by pulling the module out of the safe housing through the door using the extendable mount 122. It will be appreciated that as an alternative the safe door may open at a front or side of the ATM. The cradle is fixed to the safe and helps aid smooth running of the lower module in and out of the safe during a "racking" process.

An upper surface of the safe housing includes a first aperture 128. Each aperture in the safe housing is a through opening that enables items of media such as bank notes or checks or the like to pass into and out of the lower secure module which can contain currency cassettes etc. The apertures shown are slits but it will be appreciated that other shapes of aperture could be used. One, two, three, or more apertures formed as through holes in a safe wall could be used.

FIG. 1 helps illustrate how an upper removable module 130 may be mounted in the ATM 100 so that it may be selectively racked in and out of an ATM by an operator. A respective telescopic mounting system 132 interacts between an upper cradle 134 of the ATM and the removable module that can be moved/slid in and out of the ATM. Sliding the upper module in and out enables an operator to carry out maintenance and/or replace parts in the upper container element. As illustrated in FIG. 1 the upper moveable module includes an associated media handling subsystem which takes media from an input pocket 140 through the ATM. Alternatively a slit may be used as an alternative to a pocket. Likewise media items can be passed through the ATM and passed to a user via the same pocket 140 used as an exit pocket during withdrawal.

FIG. 1 helps illustrate how a total media item pathway 150 includes a substantially horizontal (left to right in FIG. 1) pathway portion 151 which includes elements to identify currency or checks and process those media items. The media item pathway then includes a vertical downwards but inclined portion 155 leading to opposed rollers 156, 157 which can be selectively driven to move media items to the left in FIG. 1. If media items are moved to the left by the rotating elements 156, 157 the items can be eventually moved downwards via a media item pathway portion 160 towards an intermediate transfer module 170. The media items thus move along a portion of a media item pathway in a generally vertical direction from the upper module 130 to a lower module 120.

FIG. 1 helps illustrate alternative sections (or portions) of the total media item pathway 150 and illustrates how the ATM 100 shown in FIG. 1 has an aperture 128 which enables media items to be selectively passed into the safe or out of the safe depending upon whether a deposit or withdrawal operation is taking place. A respective transfer module 170 is used for each aperture. The respective intermediate transfer module 170 to control media item movement into/out of the safe is used to help define a portion of a total media item pathway as an item of media such as a banknote moves from an upper region of an ATM into the safe or from the safe into the upper region. Movement is dependent upon an operation being carried out at any moment in time by the ATM 100.

FIG. 1 illustrates a schematic side view of the ATM 100 and helps illustrate the upper module 130 and lower module in 120 a "racked" position. That is to say the mounts are non-extended and the ATM is shown in an arrangement suitable for use by a customer.

Figure 2:
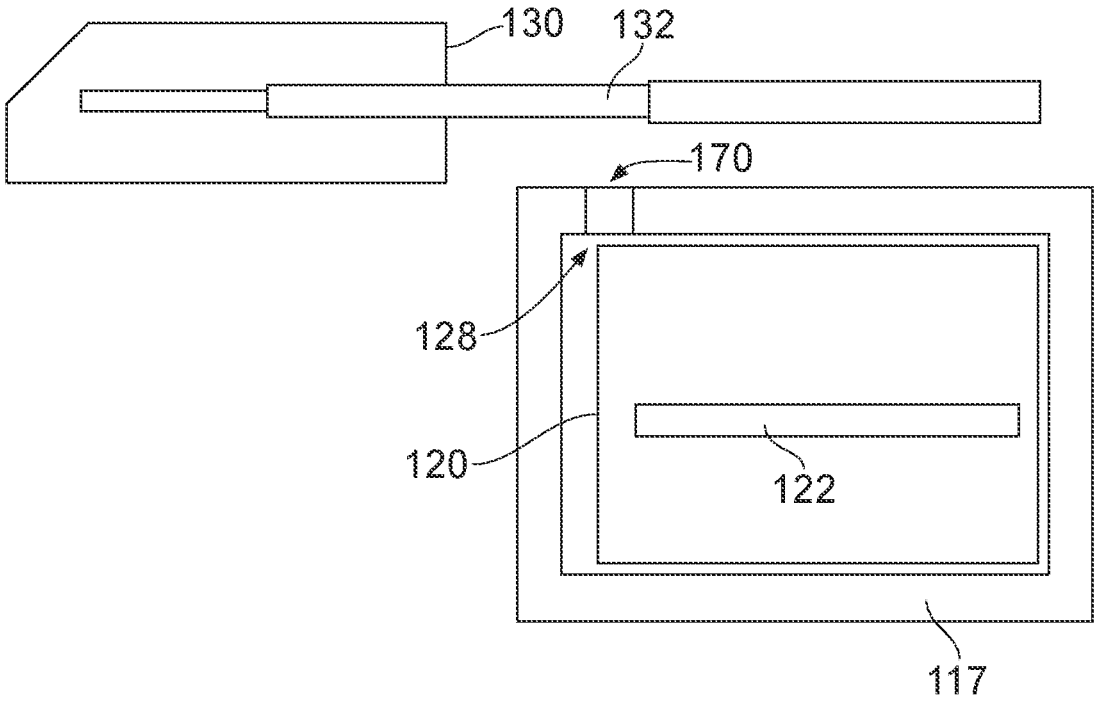
FIG. 2 illustrates an upper module "racked out" to allow an operator with access.

FIG. 2 illustrates the upper module 130 in a "racked out" state in which the upper mount 132 which is a telescopic mount has been pulled out to a full extent by an operator. This helps an operator carry out maintenance. The lower module could likewise be removed from the safe (or "racked out") for maintenance or replenishment purposes.

Figure 3:
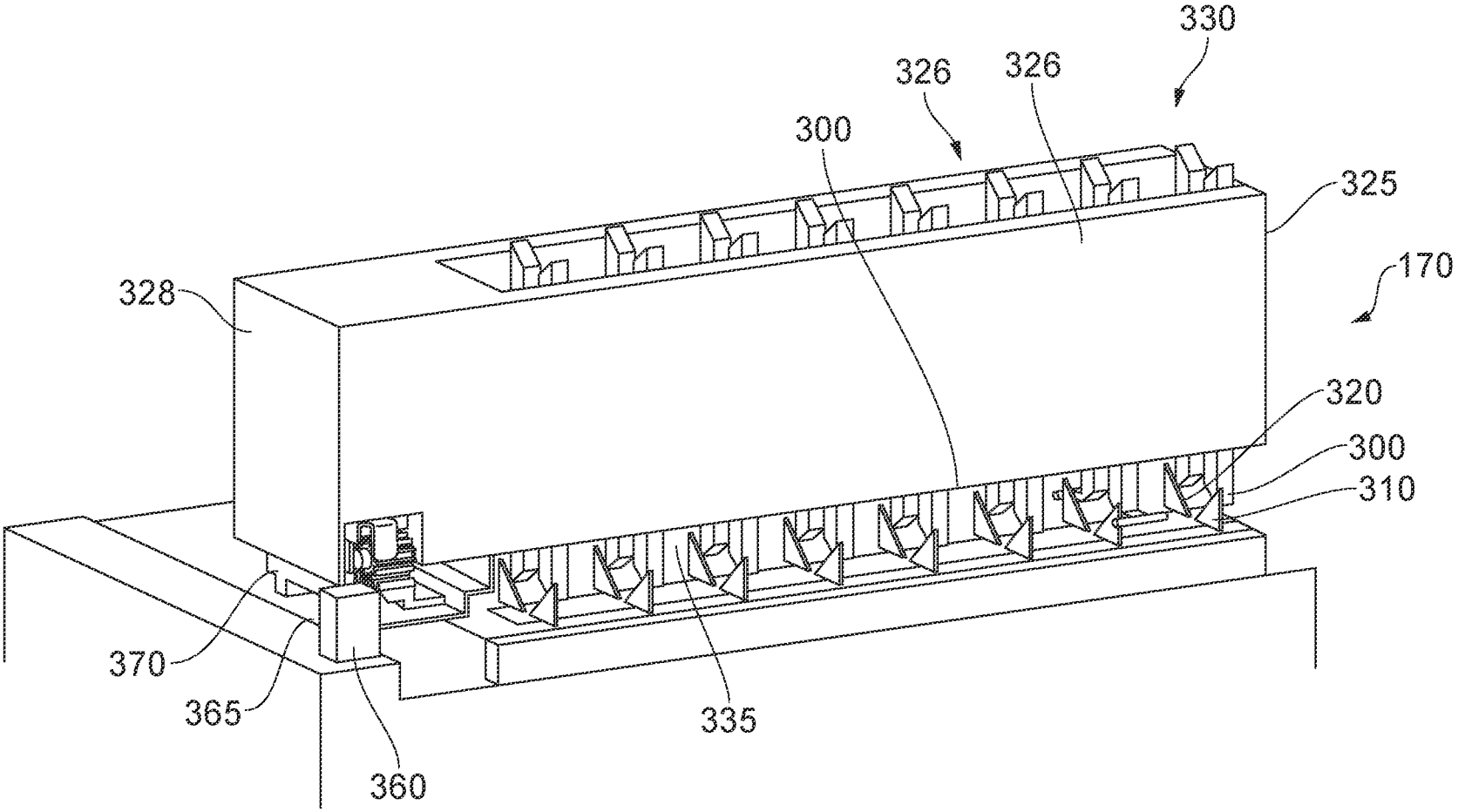
FIG. 3 illustrates an isometric view of a transfer zone between of a transfer module and a removable lower module.

FIG. 3 illustrates a view of a transfer module 170. The transfer module 170 shown in FIG. 3 is an intermediate transfer module useable to transfer items of media from the upper module into the lower removable module 120 in the safe. Alternatively the intermediate module can help transfer items of media from the safe upwards into the upper module for presentation to a customer. As illustrated in FIG. 3 the transfer module is a fixed in place module. That is to say a housing of the module is secured to an upper surface of the safe and once installed does not move. By contrast a lower removable unit can be racked in and out of the safe. As the lower removable unit is pulled out by an operator to provide access, for maintenance or replenishment, arms 300 carried on respective shafts (shown below in further figures) are moved into a retracted position (see below). In this way the arms which are disposed in a spaced apart relationship along each shaft will not inhibit motion of the adjacent module as it is removed. As illustrated in FIG. 3 two spaced apart rows 310, 320 of protruding guides that provide guide elements extend upwardly from the removable module. The two spaced apart rows of upwardly protruding guide elements cooperate with the arm elements when the arm elements are in an operational position as illustrated in FIG. 3 to help guide items of media as they are transported through the transfer module out of the safe and into the upper module or from the upper module downwards into the safe.

As illustrated in FIG. 3 the transfer module 170 includes a rigid cuboid shaped housing 325 which includes two spaced apart long sides 326 separated by end walls 328 which are likewise in a spaced apart relationship. The housing has a top opening 330 and a lower opening 335. FIG. 3 also helps illustrate how a drive post 360 is provided in an upstanding relationship on the removable module. The drive post 360 is an example of a drive element. The drive element moves with the removable module 120 as an operator removes the unit and then replaces it back into the safe. As the removable module is located back into a safe an abutment surface 365 on the drive post abuts with a pusher plate 370. The pusher plate 370 (described in more detail below) moves away from a biased position in which the arms mounted on the shafts of the transfer module are disposed in a retracted position. Movement of the pusher plate causes shafts on which the arms are mounted to rotate as the drive post pushes the pusher plate laterally towards the left-hand side and into the page in FIG. 3. The drive element is thus disposed to move with the removable module to engage with the pusher plate at a push surface of the pusher plate when the removable module is moved towards and proximate to the transfer module. As an alternative the drive element could be a recessed wall in the removable module and the pusher plate could include a leg that moves in the recess and be driven by the recess wall.

Figure 4:
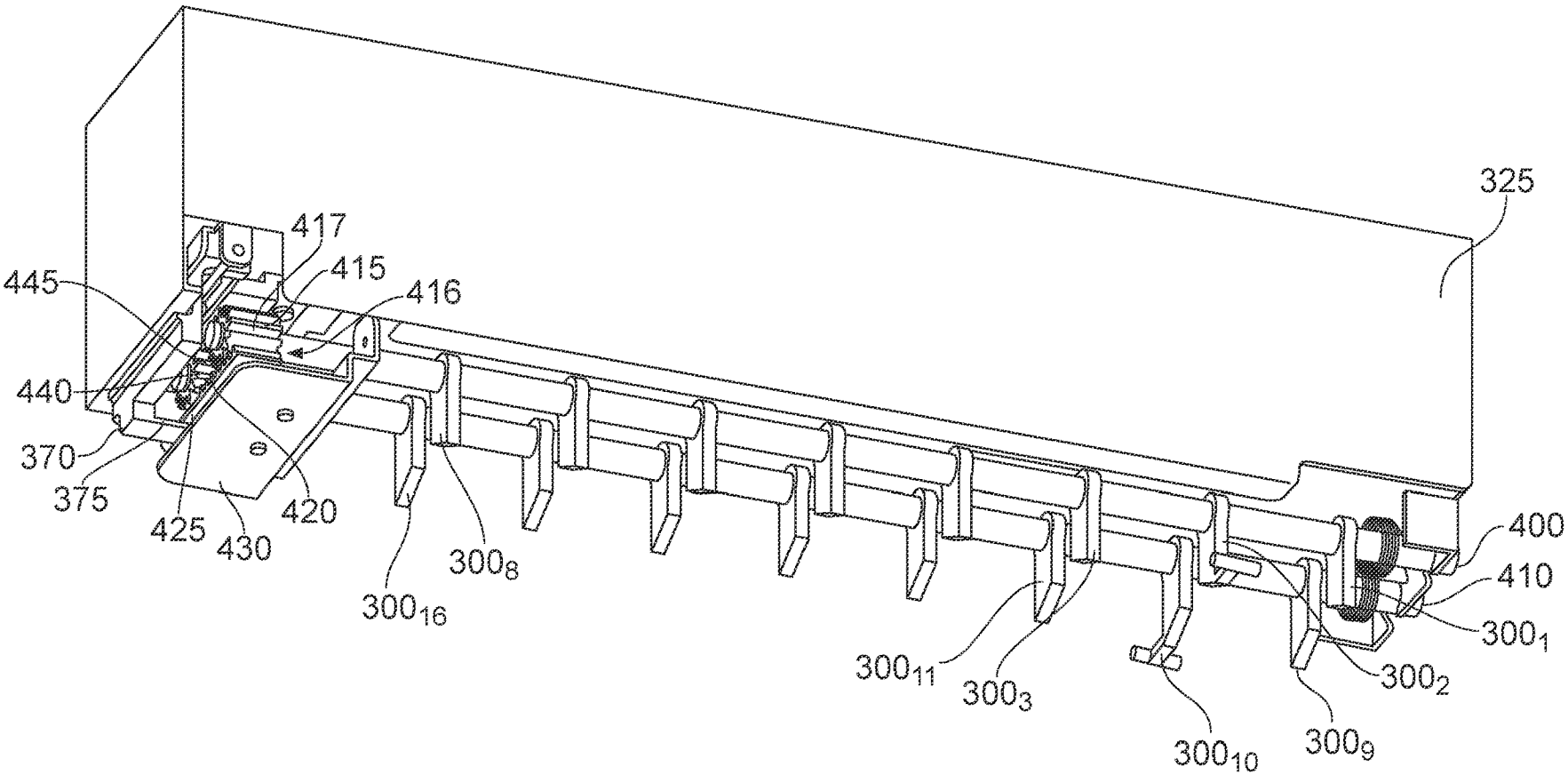
FIG. 4 illustrates a lower isometric view of an area between the transfer module and lower module.

FIG. 4 helps illustrate a transfer module in more detail. In particular FIG. 4 helps illustrate how the housing is provided by spaced apart long side walls 325, 326 and this creates a space within the housing. Within the space a first shaft 400 and a further shaft 410 are supported in a substantially parallel spaced apart relationship. Each shaft is an elongate body that can rotate. The first shaft 400 illustrated in FIG. 4 as being closer to the observer carries a respective plurality of spaced apart arms 300. Eight arms 3001 to 3008 inclusive are shown on the first shaft 400 in FIG. 4. It will be appreciated that the length of the shaft and the number of arms carried by each shaft can be selected according to the size of the media items being transported and thus the width of the apertures in the safe. The arms shown are discrete elements secured to respective shafts. Alternatively each shaft and its respective plurality of spaced apart arms may be integrally formed. The arms are each comprised of an elongate body that is integrally formed with a single respective shaft element or alternatively are an elongate body that is secured to a respective shaft element at a root region of the arm element. Each elongate body that comprises an arm includes a first edge and a remaining edge. The arms can all have a similar general shape (except some may include on abutment element as described below) and overall configuration or alternatively most of the arms will have a given shape and other arms which carry a respective abutment member can have a modified general shape to provide a support for the abutment feature. This is described hereinafter in more detail.

FIG. 4 helps illustrate a first pinion 415 secured on a pinion end 416 of the shaft 400. The pinion is an element with respective pinion teeth 417 and these teeth engage with respective lower rack teeth 420 of a lower rack. The lower rack 425 is an element that is moveable and slides with respect to a shaft support 430. The shaft support 430 may be secured to the safe similar to how the transfer module housing 325 is fixed in place to effectively lock those components in a fixed position with respect to the safe.

FIG. 4 helps illustrate how the pusher plate 370 includes a lower rack contact arm 375. As the pusher plate is driven by the drive post 360 that moves with the lower removable module the pusher plate is pushed in a direction into the page in FIG. 4. This drives the associated lower rack contact arm 375 which engages at a distal end with the lower rack 425. This creates a turning motion on the pinion 415 which thus creates an associated rotation of the shaft 400. In this way the guide arms 300, which are shown in an operational orientation in FIG. 4 can be turned into the operational position from a retracted position (this is shown more clearly in FIG. 5). FIG. 4 also helps illustrate how the remaining shaft 410 which carries a respective plurality of spaced apart arms 3009 to 30016 inclusive has a respective pinion 440 with respective pinion teeth 445. An upper rack is moved by a further upper rack contact arm of the pusher plate to rotate that shaft.

Figure 5:
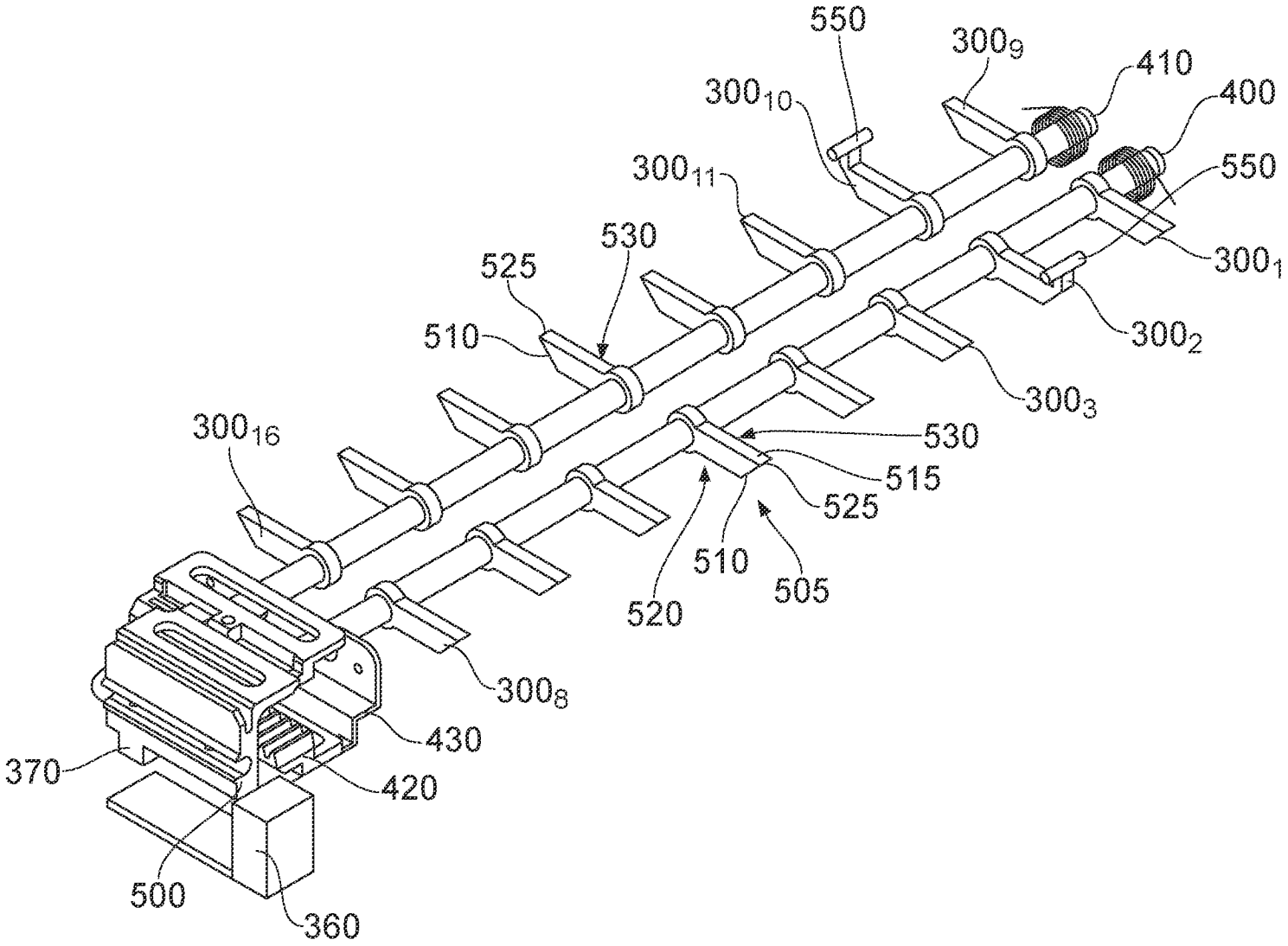
FIG. 5 illustrates an isometric view further detailing some spaced apart shafts, arms of the shafts and a co-operating driver and pusher plate.

FIG. 5 illustrates the spaced apart shafts 400, 410 each with a respective plurality of guide arms in more detail. In the orientation shown in FIG. 5 the arms are in a retracted position. In a retracted position the adjacent lower (or alternatively upper) module can be readily racked out of the safe without concern that the otherwise downwardly extending arms would impact on part of the lower module. The shafts are biased into the retracted position by respective biasing elements as described in more detail below.

FIG. 5 helps illustrate how the drive element formed as a drive post 360 with abutment surface 365 can abut with a pusher surface 500 of the pusher plate 370. As the pusher plate is moved, respective lower and upper rack contact arms cause respective racks to move laterally causing an associated rotation motion of the two shafts. The drive force formed by motion of the racking overcomes the biasing force that biases each shaft to locate associated arms into the retracted position. In this way in the retracted position a transfer module and removable module are laterally locatable with respect to each other. In an operational position when the transfer module and the removable module are in a fixed respective location with respect to each other the tip region 505 of a guide surface 510 of each arm is located at a desired location. The tip region of a guide surface of each arm is spaced at least a predetermined threshold distance from a guide surface provided by an adjacent guide element of the removable module as will be described hereinafter in more detail.

FIG. 5 helps illustrate how each arm is an element that comprises an elongate body. Each elongate body comprises a first edge 515 and a remaining edge 520. The first edge 510 extends between a terminal end 525 of a respective arm to a root region 530 of an arm. The root region is region proximate to the shaft from which the respective arm extends. The remaining edge 520 of each arm is curved or is angled (in FIG. 5 the remaining edge is shown angled as the remaining edge extends from the terminal end extremity 525 to the root region). The body of each arm thus has a thickness in cross section that is greater proximate to the root region than at the terminal end extremity.

FIG. 5 helps illustrate how an at least one arm 3002 carried by a first shaft 400 includes a rod-like abutment member 550. Illustrated in FIG. 5 a further arm 30010 on the remaining plurality of arms carried by the other shaft 410 likewise has a respective abutment member 550. Each abutment member is a generally rod-like element that presents an outer substantially cylindrical contact surface. The abutment members abut with lower guide elements of the underlying lower module (or with guide elements of an upper module) and the impact of abutment members carried by the arms and guide elements of a removable module act as respective reference points so that regardless of exact orientation between the fixed transfer module and the removable module the arms and guide elements are co-located in a desired orientation which helps determine a portion of a pathway for an item of media in such a way that the risk of jamming is wholly or at least partly mitigated.

Figure 6:
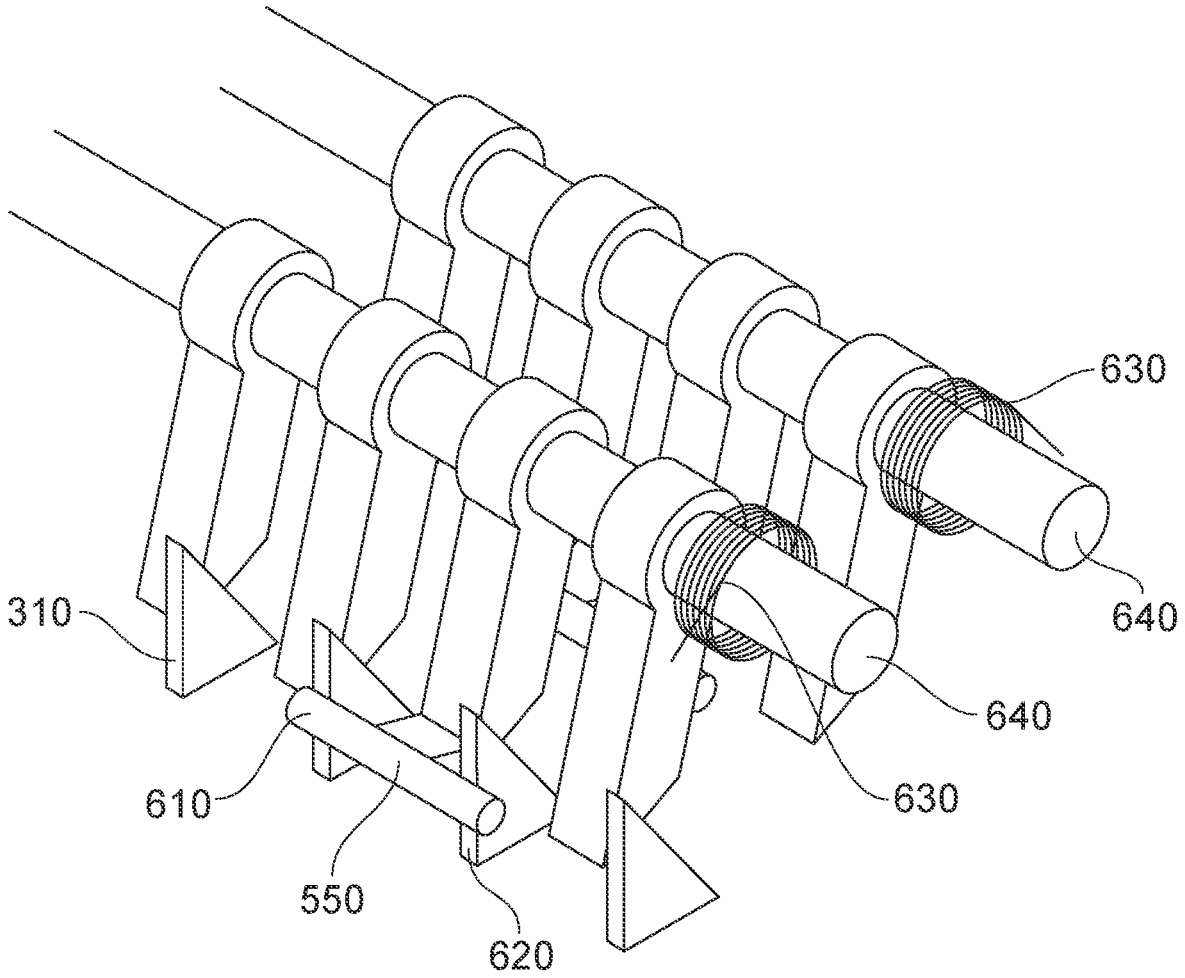
FIG. 6 illustrates an abutment member and torsion springs biasing spaced-apart shafts.

FIG. 6 helps illustrate two spaced apart rows of teeth like protruding guides. These may be referred to as combing elements. As illustrated in FIG. 6 a first row 310 is provided by spaced apart upwardly extending projections and these are separated from a further row 320 of similar upstanding projections. The upstanding projections resemble teeth and the teeth provide guide elements of a removable lower module. The two rows are spaced apart about a slit in the lower guide body which aligns with the aperture in the safe to allow media items to pass therethrough.

FIG. 6 helps illustrate a bar 550 which extends between two adjacent guide elements. The bar 550 is carried by an arm on a shaft and has a substantially cylindrical outer surface 610. The bar 550 illustrated in FIG. 6 is an example of an abutment element. Whilst the bar 550 illustrated in FIG. 6 is shown secured to and stretching across to adjacent protruding teeth it will be appreciated that it may only be secured at a single end to an arm carried on the shaft 400 to abut with a single guide element or multiple guide elements to one side. Alternatively the bar may stretch across multiple guide elements. The rod provides an abutment element so that as an arm that carries the abutment rod moves from a retracted position in which each arm carried by a shaft is substantially horizontal into an operational mode in which arm is generally upright the cylindrical outer surface of a rod abuts with a contact surface 620 of at least one upstanding (or downwardly extending if referring to an upper module) guide element. As illustrated in FIG. 6 the projecting combing elements of a row in the lower module immediately adjacent to an arm which carries an abutment element have a modified cross section relative to combing elements which are not planned to abut with an abutment member. The guide surface 620 offered up by combing elements that will be impacted by a rod-like abutment member present a substantially vertical abutment surface. Having a generally cylindrical outer surface for the abutment element and a generally vertical abutment surface on combing elements adjacent to an arm that carries an abutment element results in a precise definition of a mutual relationship between arms carried by a shaft and the rows of guide teeth of a removable module. It will be appreciated that other shapes and sizes of abutment elements could of course be envisaged. For example ends of an abutment member could run in a cooperating recess on a side wall of a protruding guide that provides a combing element. Alternatively the abutment element which is an elongate body extending from at least one end from an arm may have an elliptical or hexagonal or square or rectangular cross-section along part or a whole of its length.

FIG. 6 helps illustrate how an arm that carries an abutment element can have a slightly different shape and configuration from the remaining arms carried by the shafts. The body of the arm that carries an abutment element has a shape and configuration so that the abutment element is held at a desired orientation to cooperate with abutment surfaces on the combing elements to set the arms carried by the shafts at a desired location.

Providing a part or parts of one or more arms on each plurality of arms carried by each respective shaft that engages with a part or parts on one or more respective protruding guide teeth of a combing element means that a relative location of the arms and combing teeth when a module is replaced into an ATM is set by a mutual relationship between fixed and moveable parts in the ATM. This is advantageous relative to conventional techniques which otherwise utilize a fixed position on a transfer module to set location of arms.

FIG. 6 also helps illustrate how a respective torsion spring 630 at a spring end region 640 of each shaft is secured at a first spring end to the housing. The other spring end is secured to a shaft. The spring is a biasing element that biases a shaft in a first direction of rotation that biases arms into a retracted position.

Figure 7:
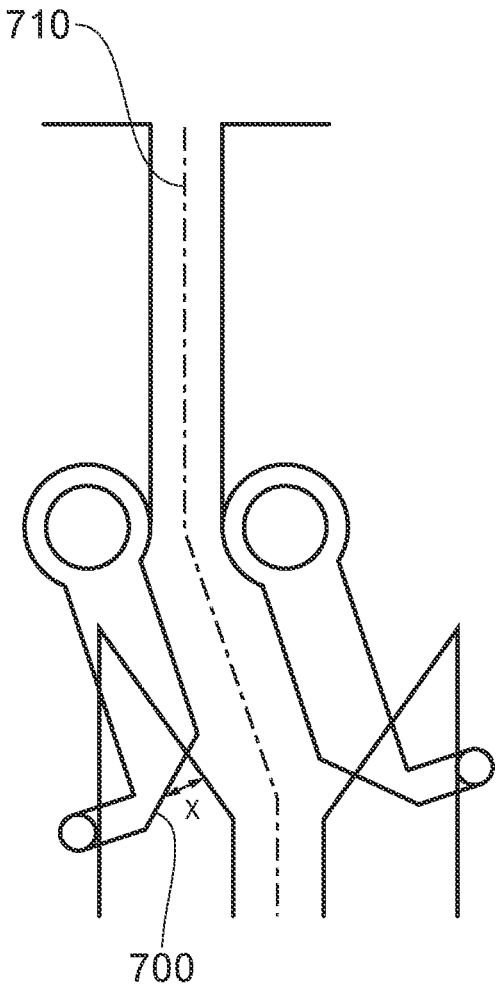
FIG. 7 illustrates a side view of parts of the transfer module and removable module, identifying the points of contact between the arms on shafts and protruding guide elements with modules at one extreme of alignment.
Figure 8:
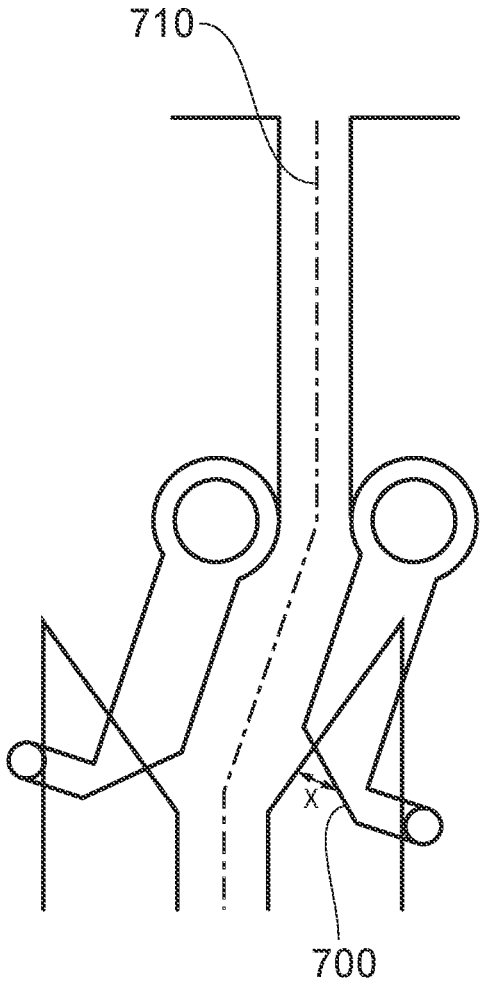
FIG. 8 illustrates an alternative extreme of alignment.

FIGS. 7 and 8 illustrate how the cooperating abutment member carried by one or more arms on a shaft and protruding guide teeth such as combing elements of a removable module can cooperate to determine a portion of a media item pathway between a lower removable module and parts of a transfer module. In FIG. 7 a lateral (left to right in FIG. 7) extreme position of parts of the lower module is shown in the most right-hand side position possible. This positional effect can occur because of manufacturing tolerances on parts of a racking mechanism. By contrast FIG. 8 helps illustrate parts of the lower removable module in its most left-hand side lateral position with respect to the fixed transfer module. In both instances it can be seen that regardless of the respective resulting lateral position of the lower module (similar arguments apply to an upper removable module) and the parts of the transfer module when the removable module is racked in, then the guide surfaces offered by the arms carried on the shaft are always provided at a desired co-location with respect to guide surfaces of the guide elements of the lower (or upper) transfer module. In this way a portion of a media item pathway is determined. FIGS. 7 and 8 help illustrate how a tip region 700 of a guide surface of each arm extends for a distance of at least 5 mm along an edge of a respective arm element away from a terminal end extremity. Aptly as an alternative the distance is around 3 mm or 4 mm or 6 mm. A whole of that tip region, that is to say a whole of the 5 mm from the tip extremity, is at least a predetermined threshold distance X set back from a guide surface of an adjacent guide element when viewed in an end on view. That is to say at least a predefined distance of a tip of any arm is always set a distance back from a guide surface of an adjacent guide element in a side on view. Aptly the setback distance is around 1 mm or 2 mm or 3 mm or 4 mm. This minimum setback distance helps ensure that a media item being transferred along a portion 710 of a total media item pathway can never accidentally find an edge of the media item infiltrating its way between the opposed guide surfaces.

Figure 9:
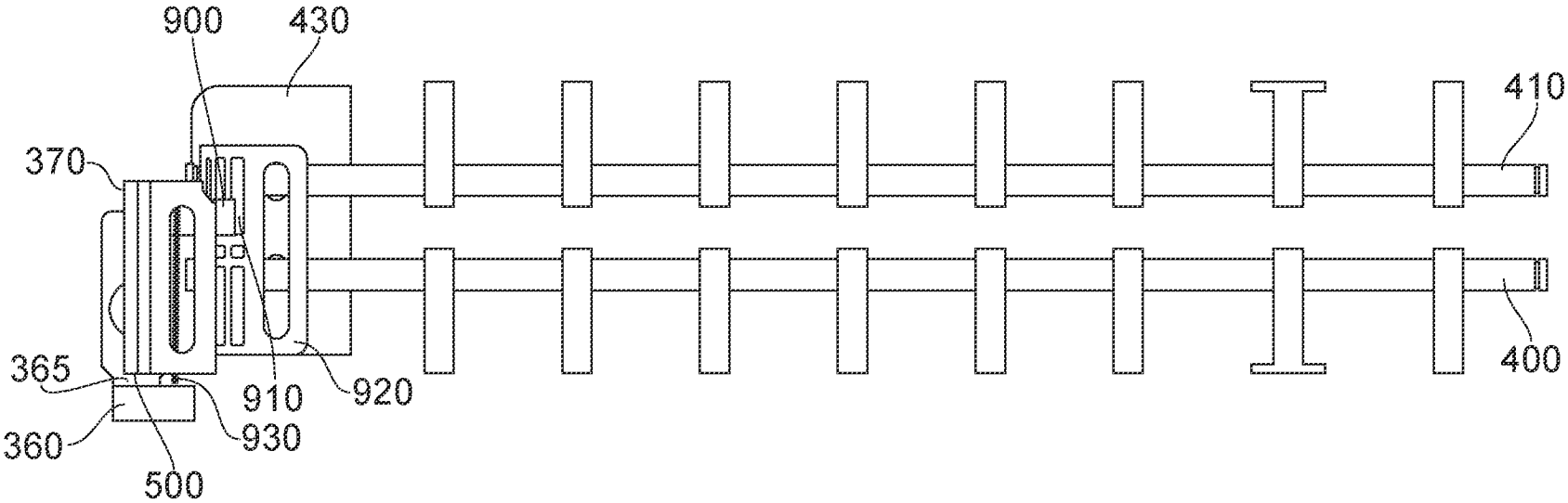
FIG. 9 helps illustrate spaced apart shafts from a top plan view.

FIG. 9 illustrates a view from above of a drive post 360 with associated drive surface 365 and how this pushes against a pusher surface 500 of the pusher plate 370. As illustrated an upper rack contact arm 900 is provided on the pusher plate 370 and this is shown in abutment with a contact surface 910 on an upper part 920 of the upper rack member. Also illustrated in FIG. 9 is a rigid shaft support 430.

FIG. 9 helps illustrate a position before the drive post 360 begins to impact on the pusher plate. A spring 930 biases the pusher plate into a predetermined position (downwards in FIG. 9) in this position the upper rack contact arm 900 causes the upper rack to be likewise positioned in a downwards motion. Effectively the pusher plate pulls the racks overcoming the natural tendency (caused by the torsion spring acting on the shafts) of the racks to be in a higher (in FIG. 9) position. In this position a lower rack contact arm 375 likewise positions a lower rack and so the two shafts 400, 410 are rotated into the position which places the arms in a retracted position.

Figure 10:
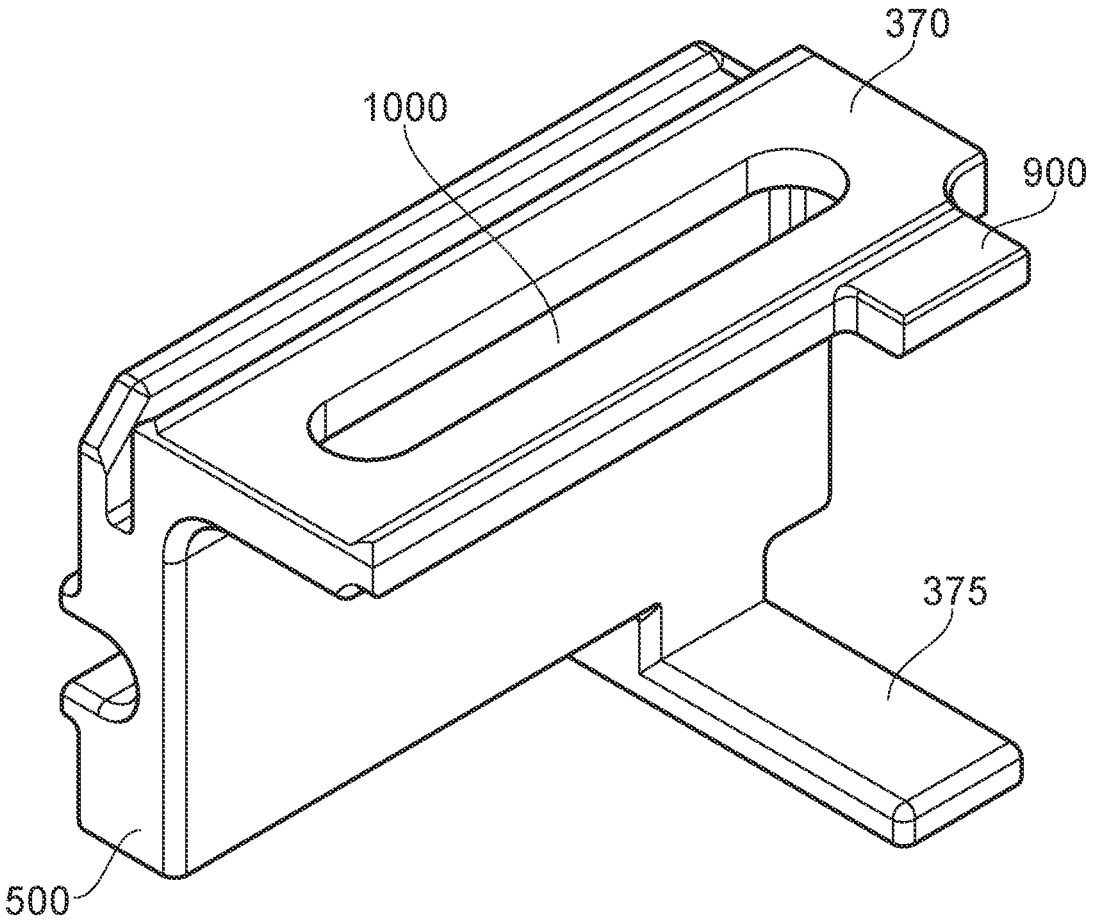
FIG. 10 illustrates a pusher plate.

FIG. 10 helps illustrate the pusher plate in more detail and helps illustrate the lower rack contact arm 375 and the upper rack contact arm 900. As the drive post 360 pushes against the pusher plate contact surface 500 the rack contact arms move with the plate and this movement releases pressure on the racks and causes respective racks to move since respective pinions with teeth meshed with those racks are driven by torsion springs to independently move. FIG. 10 helps illustrate a guide slot which enables a sliding motion of the pusher plate but enables the pusher plate to effectively be mounted in the transfer module.

Figure 11:
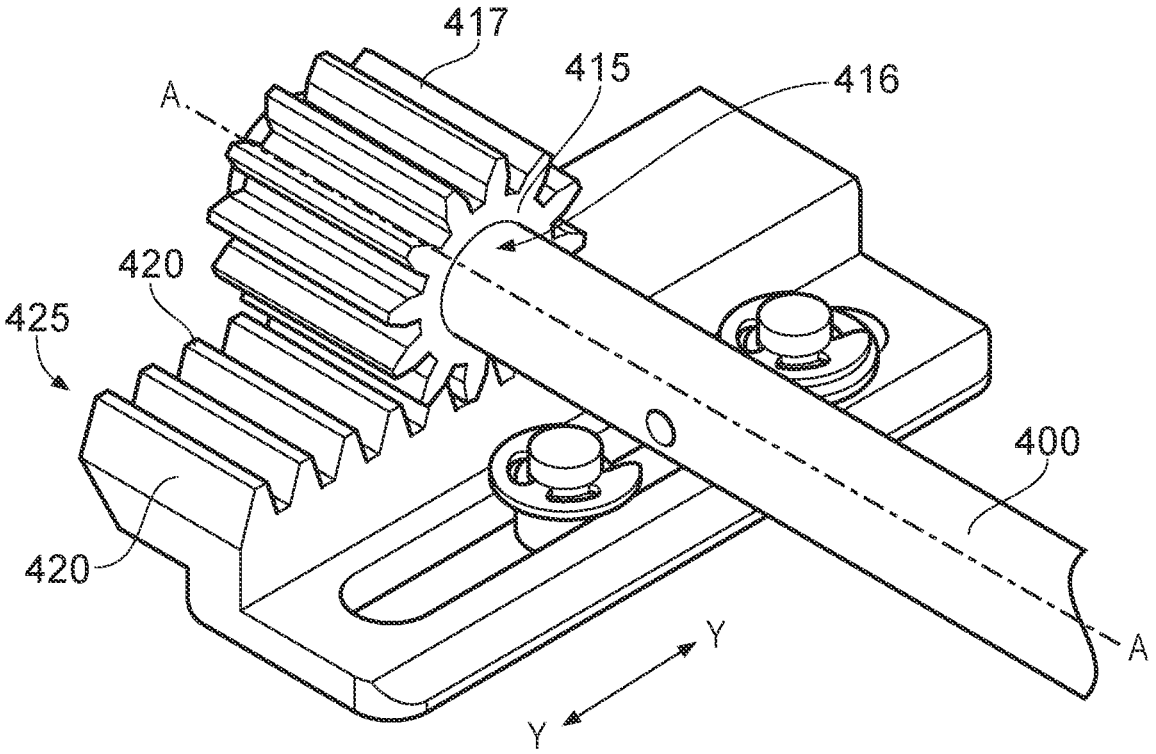
FIG. 11 illustrates a lower rack and associated pinion on a shaft.

FIG. 11 illustrates the lower rack 425 with associated teeth 420 in more detail and helps illustrate how the pinion 415 is rotated when a lateral motion illustrated by the arrows Y-Y in FIG. 11 is moved as the pusher plate moves. As the rack teeth move in the direction Y-Y the pinion teeth rotate and this causes the shaft 400 to rotate about a respective shaft longitudinal axis A-B. If the pusher plate is pushed the racks move because the shafts cause them to move. With the pusher plate not pushed the spring of the pusher plate causes the racks to be pulled.

Figure 12:
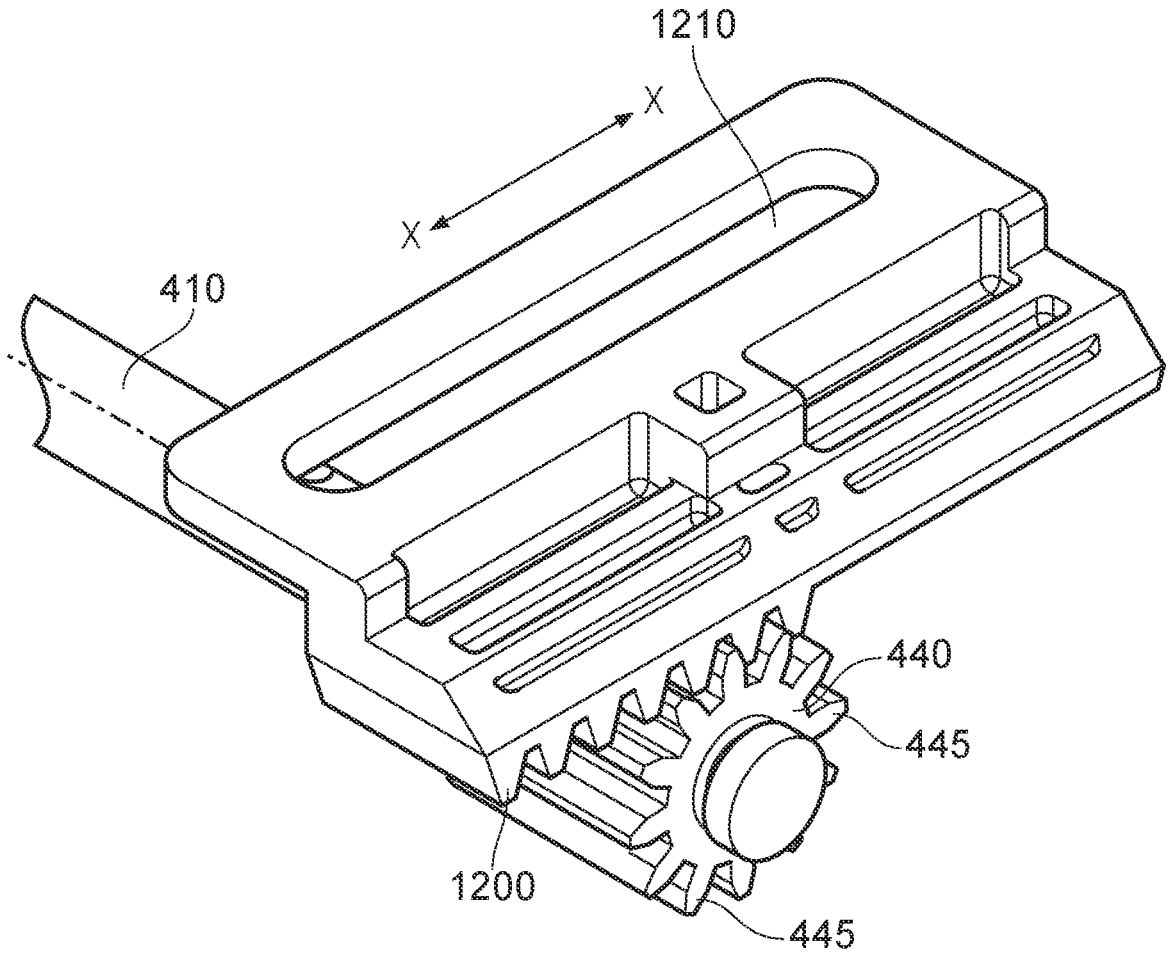
FIG. 12 illustrates an upper rack and associated pinion on a shaft.

FIG. 12 illustrates the alternative shaft 410 of the pair of spaced apart substantially parallel shafts. This is mounted at a pinion end of the shaft 410 to a respective pinion 440. The pinion has teeth 445 which mesh with a rack elements teeth 1200 as the upper rack is caused to move in a lateral direction illustrated by the arrows X-X in FIG. 12. This motion is induced by virtue of the pusher plate being driven or not by the drive post and the pusher plate spring. The upper rack body has an elongate slot 1210 which enables sliding motion of the rack whilst still being able to hold the rack or support the rack in a location in the transfer module.

Figure 13:
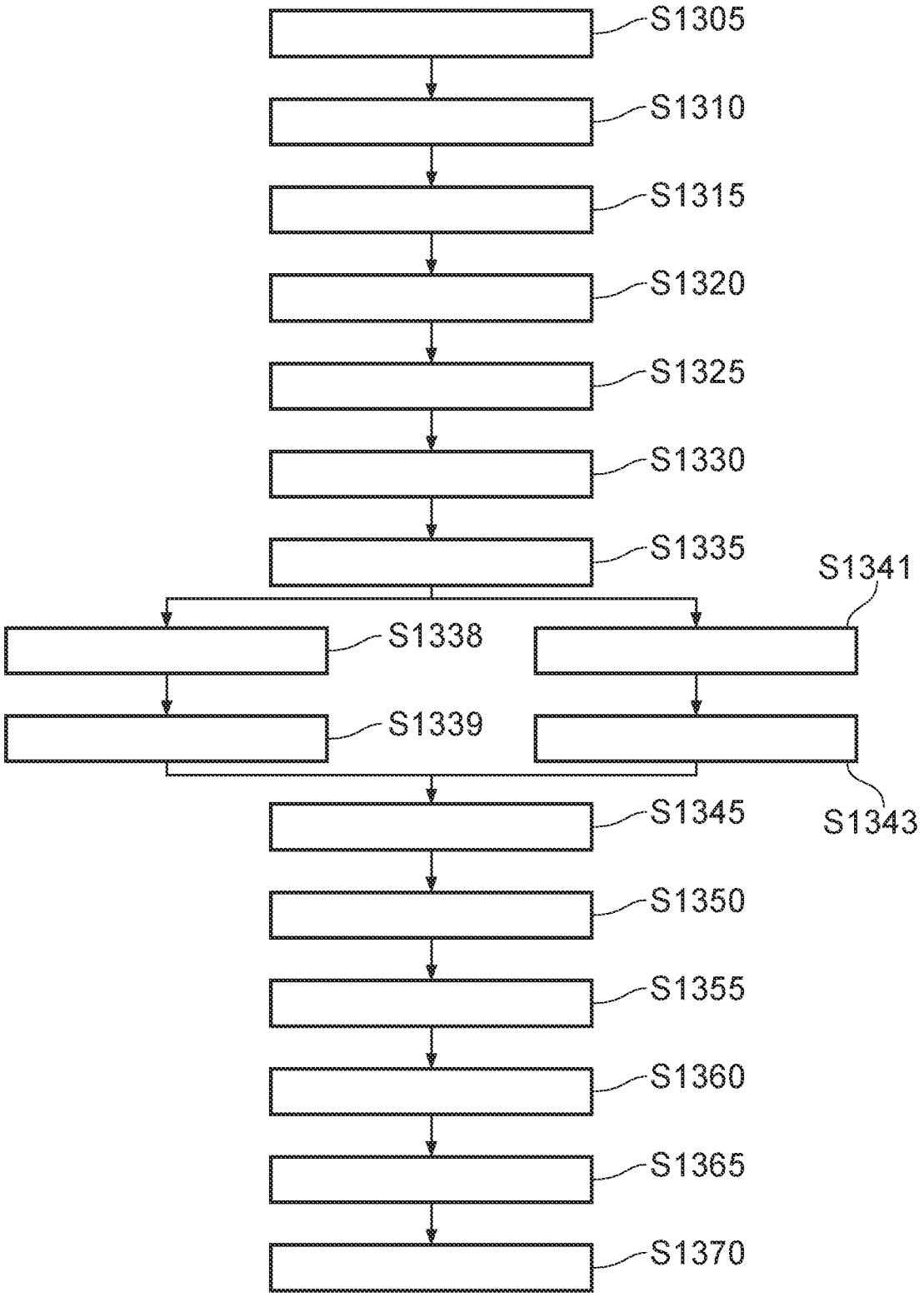
FIG. 13 illustrates steps during a racking out process associated with a removable module.

FIG. 13 illustrates a methodology for unracking a removable module from the ATM. At an initial step S1305 the lower module is fully racked. That is to say the telescopic mount is not extended and the lower removable module is within a safe. At a next step S1310 the ATM previously in an operational state is turned off for maintenance. At a next step S1315 the ATM safe door is opened by security personnel. At a next step S1320 the lower module cradle supporting the lower module begins to be slid out of the safe housing on telescopic sliders this may be achieved by an operator pulling on a handle on the lower removable module. In a next step S1325 the drive plate attached to the lower module cradle continues to slide out of the ATM. The drive post moving means that the pusher plate is no longer driven by the drive post. At the next step S1330 the pusher plate, being no longer confined/located by the drive post and by virtue of the biasing spring, begins to slide freely towards its rest position. The pusher plate has arms that abut with cooperating abutment elements in the form of respective outstanding walls of the body of the upper and lower racks moving them into the same direction as the pusher block. This is illustrated as step S1335 in FIG. 13. Via step S1338 is illustrated the pinion meshing the upper rack being rotated in a clockwise direction. The rotatable shaft which moves with the pinion is illustrated as being rotated likewise in a clockwise direction via step S1339. Simultaneously with motion of the upper rack and its associated shaft the movement of the pusher plate illustrated in step S1335 causes the pinion meshing with the lower rack to be rotated in an anti-clockwise direction when viewed from the pusher plate end of the shaft. This is illustrated by step S1341. The rotatable shaft element attached to the lower pinion is rotated likewise in an anti-clockwise direction. This is illustrated by step S1343.

The rotatable arms attached to the rotatable shafts rise from a lowered operational position towards a retracted position. A torsion spring attached to a spring end of each shaft is rotated against its bias increasing its tension. This is illustrated in step S1345. The pusher block/plate now reaches a rest position with no tension in the linear spring which biases the pusher block. This is illustrated in step S1350. Via step S1355 is illustrated that the pusher plate stops driving the upper and lower racks. The pinions meshing the upper and lower racks stop rotating and the rotatable shafts attached to the pinions likewise stop rotating. At this point the guide arms stop rising as they have reached their retracted positions. This is illustrated in step S1360. The lower removable module cradle can now be slid to a full extension on the telescopic sliders by a human operator this is illustrated by step S1365. At this point the lower module can be fully racked out and maintenance or replenishment can take place illustrated as step S1370.

Figure 14:
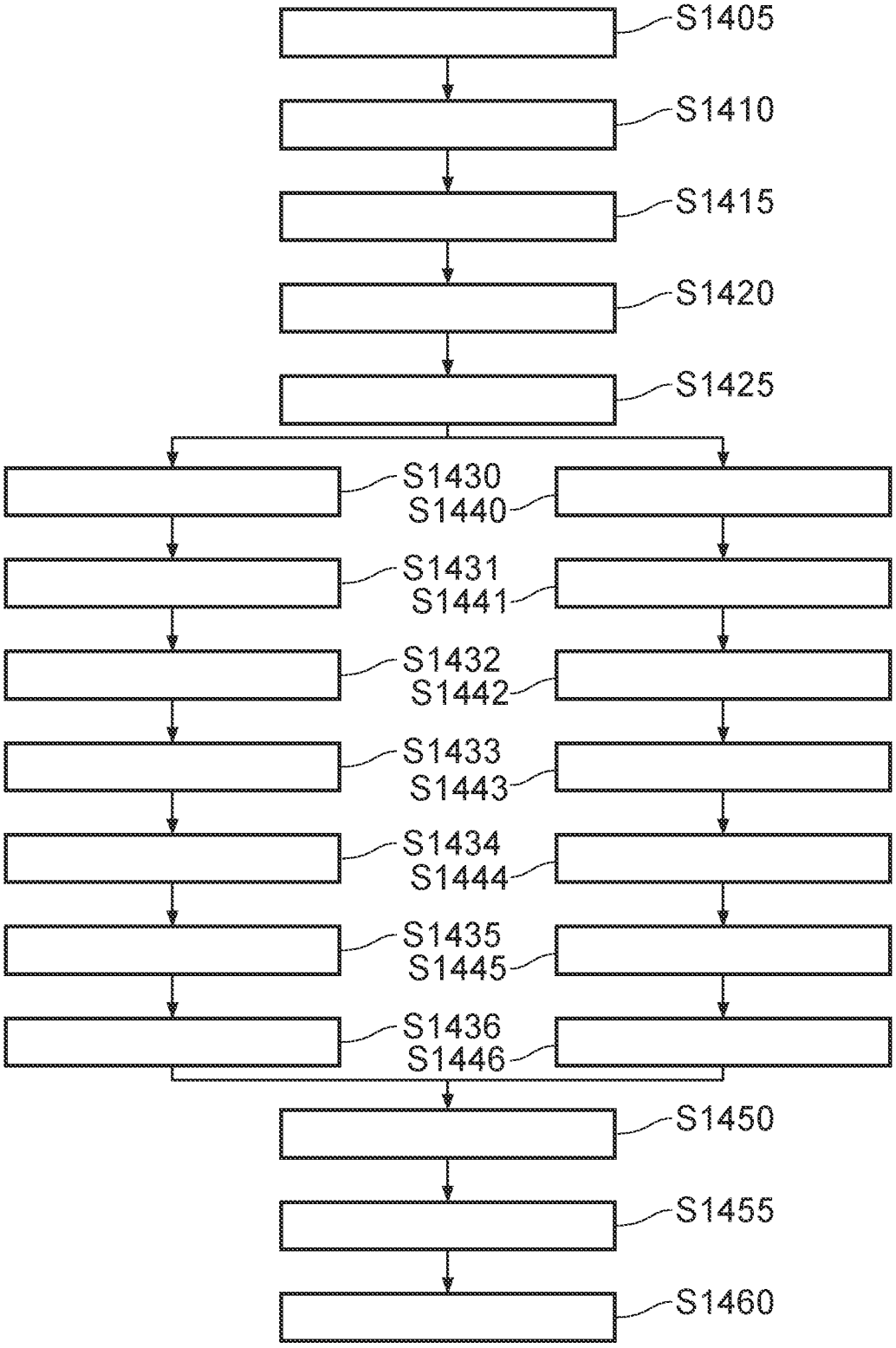
FIG. 14 illustrates a racking process in which a removable module is located back within an SST.

FIG. 14 illustrates certain steps in a racking in process. The ATM starts in a maintenance state S1405 with the safe door open and lower module cradle slid fully out. Via step S1410 is illustrated the lower module cradle containing the lower module beginning to be slid or 'racked' into the safe housing on the telescopic mounts. This is achieved by an operator pushing the removable module into the safe. Next at step S1415 the drive post attached to the lower module cradle slides into the ATM. At some stage indicated by step S1420 the drive post runs into and abuts with the pusher surface of the pusher plate and begins to drive the pusher plate in the same direction as the drive post. The upper and lower racks lose an urging force on them and are no longer fully constrained by the pusher block. This is illustrated by step S1425.

Step S1430 and the steps below it on the left hand side in FIG. 14 relate to actions and experiences of the upper rack. In step S1430 the torsion spring attached to one end of a rotatable shaft causes rotation of the rotatable shaft in an anti-clockwise direction. Arm elements attached to that rotatable shaft begin to lower from the retracted position. Via step S1431 is illustrated that the pinion attached to the rotatable shaft element is driven in an anti-clockwise direction. Step S1432 illustrates how the upper rack, meshed with that pinion is driven in the direction of the pusher plate. Step S1433 illustrates how an abutment member attached to the back of one or more arm elements on that shaft eventually abuts with the unmoving back abutment surface on a protruding guide. This stops the lowering action of all the arm elements on that shaft. At this point the set of arms attached to this rotatable shaft are correctly aligned in an operational location. Guide surfaces of the arm element and guide surfaces of the protruding guide elements of the removable module are spaced apart to minimize any chance of infiltration between them with a media item. The next step S1434 illustrates how the pinion attached to the rotatable shaft element is held stationary. The upper rack, meshed with the pinion is also held stationary. This is illustrated in step S1435. Step S1436 illustrates the upper rack losing contact with the pusher plate which is still being moved. The steps S1440 to S1446 mirror the steps S1430 to S1436 but with respect to the remaining shaft and its associated arms and associated pinion and rack.

Step S1450 represents the lower removable module cradle reaching a rest (racked in) position. This step is associated with the drive post which is attached to the lower removable module likewise reaching a rest position. The pusher plate, abutting with the drive post, is held in position by the drive post. This is illustrated via step S1455 in FIG. 14. The final step S1460 illustrated in FIG. 14 represents the lower module being racked and the intermediate transfer module guide surfaces being correctly aligned with similar guide surfaces of the lower module. The ATM can be switched on and can begin to move media items in or out of the safe with a portion of a media item pathway between a lower module (or upper module) and transfer module being determined in a way that wholly or at least in part mitigates a risk of jamming.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. An apparatus for determining at least a portion of a media item pathway, comprising:

a transfer module comprising a first and further rotatable shaft element in a substantially parallel spaced apart relationship; and a removable module that is locatable with respect to the transfer module to selectively locate two spaced apart rows of protruding guide elements of the removable module with respect to arm elements carried in a spaced apart relationship on the first and further shaft element; wherein at least one arm element comprises an abutment member that moves with the arm element and abuts with an abutment region of at least one guide element when a respective shaft element is rotated to move the arm element from a retracted position to an operational position in which a media item pathway is at least partially determined via opposed guide surfaces of the guide elements and the arm elements.

2. The apparatus as claimed in claim 1, further comprising:

in the retracted position the transfer module and removable module are laterally locatable with respect to each other and in an operational position, when the transfer module and the removable module are in a fixed respective location with respect to each other, a tip region of a guide surface of each arm element is spaced at least a predetermined threshold distance from a guide surface provided by an adjacent at least one guide element of the removable module.

3. The apparatus as claimed in claim 2, further comprising:

the tip region of each arm element extends for a distance of at least 5 mm along an edge of a respective arm element away from a terminal end extremity of the arm element and a whole of the tip region is at least a predetermined threshold distance of 1.5 mm set back from a guide surface of an adjacent guide element when viewed in an end on view.

4. The apparatus as claimed in claim 1, further comprising:

a first plurality of arm elements carried by a respective first shaft element is independently locatable with respect to a further plurality of arm elements carried by the further shaft element by rotating a respective first and/or further rotatable shaft element independently.

5. The apparatus as claimed in claim 1, further comprising:

a first and a further biasing element, each disposed at a biased end region of a respective shaft element and disposed to bias the respective shaft element in a favoured rotational direction.

6. The apparatus as claimed in claim 1, further comprising:

each abutment member comprises a rod element, having a cylindrical outer surface region, that extends away from and is connected to at least one arm element at an edge of an arm element that is disposed distal to a guide surface provided by a region of a remaining edge of the arm element and optionally said an edge comprises an edge that trails as the arm element moves, from a retracted to an operational position.

7. The apparatus as claimed in claim 6, further comprising:

at least one arm element of each plurality of arm elements comprises a respective abutment member that each stops rotational movement of arm elements carried by a respective shaft element at a respective desired rotational position that thereby sets the arm elements in respective operational positions.

8. The apparatus as claimed in claim 7, further comprising:

a respective desired rotational position of the first shaft element about a respective longitudinal axis of the first shaft element is independent of a respective desired rotational position of the further shaft element about a respective longitudinal axis of the further shaft element.

9. The apparatus as claimed in claim 1, further comprising:

a first and a further pinion element, each comprising respective pinion teeth disposed to engage with rack teeth of a respective one of a first and further rack element and turn as the rack element moves, wherein the first pinion element moves with, and is disposed on a pinion end region of, the first shaft element and the further pinion element moves with, and is disposed on a pinion end region of, the further shaft element and pinion teeth of the first pinion element are not meshed with pinion teeth of the further pinion element.

10. The apparatus as claimed in claim 9, further comprising:

the transfer module comprises a pusher plate member; and the removable module comprises a drive element that is disposed to engage with a pusher plate push surface of the pusher plate member when the removable module is moved towards and proximate to the transfer module.

11. The apparatus as claimed in claim 10, further comprising:

the pusher plate member comprises an upper rack contact arm, that extends towards a body of a first rack element, and a lower rack contact arm, that extends towards a body of a further rack element.

12. A method for determining at least a portion of a media item pathway, comprising the steps of:

locating a transfer module comprising a first and further rotatable shaft element in a substantially spaced apart parallel relationship, with respect to a removable module thereby locating two spaced apart rows of protruding guide elements of the removable module with respect to arm elements carried in a spaced apart relationship on the first and further shaft element;

as the transfer module and the removable module are mutually located, rotating the first and further shaft elements thereby moving arm elements carried on the respective shaft elements from a retracted position to an operational position; and when an abutment member that moves with at least one arm element, abuts with an abutment region of at least one guide element, stopping further rotation of a shaft element carrying said arm element thereby setting the arm element in an operational position thereby at least partially determining a media item pathway via opposed guide surfaces of the guide elements and guide surfaces of the arm elements.

13. The method as claimed in claim 12, further comprising:

with the arm elements carried on both shaft elements in their retracted position, locating the removable module laterally with respect to the transfer module by urging and thereby sliding the removable module that comprises a lower module into a safe housing, of an ATM, that comprises a media item aperture.

14. The method as claimed in claim 12, further comprising:

as each arm element adopts a respective operational position, locating a tip region of a guide surface of each arm element at least a predetermined threshold distance from a guide surface provided by an adjacent at least one guide element of the removable module.

15. The method as claimed in claim 12, further comprising:

independently locating arm elements carried on the first shaft element with respect to arm elements carried on the further shaft element by independently rotating each shaft element.

16. The method as claimed in claim 12, further comprising:

as the removable module is moved towards and proximate to the transfer module, automatically rotating the first and further shaft element to move arm elements into respective operational positions.

17. The method as claimed in claim 12, further comprising:

as the removable module is moved from a proximate position away from the transfer module, automatically rotating the first and further shaft elements to move arm elements into respective retracted positions.

18. The method as claimed in claim 12, further comprising:

as the removable module is moved towards the transfer module, engaging a drive element of the removable module with a pusher plate member; and as the pusher plate member is urged by the drive element, pulling at least one rack element thereby rotating a pinion element mounted to a respective shaft element and having pinion teeth meshed with rack teeth of the rack element.

19. An Automated Teller Machine (ATM), comprising:

a safe housing that comprises a safe chamber for receiving at least one currency cassette and that comprises at least one media access aperture in an upper surface;

at least one transfer module provided as an intermediate module secured proximate to a respective media access aperture; and at least one removable module comprising a lower module, slidable into the safe housing for supporting at least one currency cassette, or an upper module, slidable with respect to the safe housing; wherein a media item pathway determined for media items passing through the aperture is determined by guide surfaces of guide elements of the removable module and guide surfaces of arm elements of the transfer module that co-locate with respect to each other responsive to a mutual position when the removable module is located with respect to the first transfer module.

20. The ATM as claimed in claim 19, wherein, as the lower module is racked into the safe housing, a reference point associated with guide elements of the lower module, and not a fixed point associated with the transfer module, is used to determine the rotational orientation of an operational position of arm elements of the intermediate module, wherein guide surfaces of the arm elements are set back from guide surfaces of the guide elements in a direction away from a media item pathway by at least a predetermined distance that prevents a leading edge of a media item passing through the media access aperture from jamming.

* * * * *